US006273044B1

(12) United States Patent
Engelhardt et al.

(10) Patent No.: US 6,273,044 B1
(45) Date of Patent: Aug. 14, 2001

(54) VALVE ACTUATING LEVER

(75) Inventors: Helmut Engelhardt, Herzogenaurach; Wolfgang Mayer, Seukendorf; Johannes Meyer, Karlsfeld, all of (DE)

(73) Assignees: Bayerische Motoren Werke AG, Munich; INA Walzlager Schaeffler oHG, Herzogenaurach, both of (DE)

( * ) Notice: Subject to any disclaimer, the term of this patent is extended or adjusted under 35 U.S.C. 154(b) by 0 days.

(21) Appl. No.: 09/555,550

(22) PCT Filed: Nov. 27, 1998

(86) PCT No.: PCT/EP98/07674

§ 371 Date: Jun. 1, 2000

§ 102(e) Date: Jun. 1, 2000

(87) PCT Pub. No.: WO99/28600

PCT Pub. Date: Jun. 10, 1999

(30) Foreign Application Priority Data

Dec. 2, 1997 (DE) ..... 197 53 424

(51) Int. Cl.[7] ..... F01L 1/18

(52) U.S. Cl. ..... 123/90.41; 123/90.42; 74/559; 29/888.2

(58) Field of Search ..... 123/90.39, 90.4, 123/90.41, 90.42, 90.43, 90.44, 90.45, 90.46; 74/519, 559; 29/888.2

(56) References Cited

U.S. PATENT DOCUMENTS 5,016,582 * 5/1991 Mills ..... 123/90.39
5,655,490 8/1997 Nagano et al. ..... 123/90.41
5,775,280 * 7/1998 Schmidt et al. ..... 123/90.41

FOREIGN PATENT DOCUMENTS 195 43 657 5/1997 (DE) .
196 17 668 11/1997 (DE) .

* cited by examiner

*Primary Examiner*—Wellun Lo
(74) *Attorney, Agent, or Firm*—Pearne & Gordon LLP

(57) ABSTRACT

The present invention pertains to a valve actuating lever having a non-cut formed oblong base body which is configured essentially symmetrical to a longitudinal symmetry plane extending essentially longitudinally therefrom, a valve contact area arranged on a first end of said base body, two tabs arranged on both sides of said longitudinal symmetry plane in said valve contact area, each respectively having a lateral surface aligned facing said longitudinal symmetry plane, whereby said tabs are formed on said base body and bent over toward said valve contact area. Said tabs are arranged spaced at a clearance distance at an end edge of said oblong base body, said clearance distance being less than the clearance of said lateral surfaces in the valve contact area. At least one of the tabs has a connecting portion extending from said longitudinal symmetry plane in which the clearance between said lateral surfaces enlarges as well as at least one parallel portion in which said lateral surfaces extend essentially parallel to said longitudinal symmetry plane.

17 Claims, 2 Drawing Sheets

VALVE ACTUATING LEVER

Figure 1:
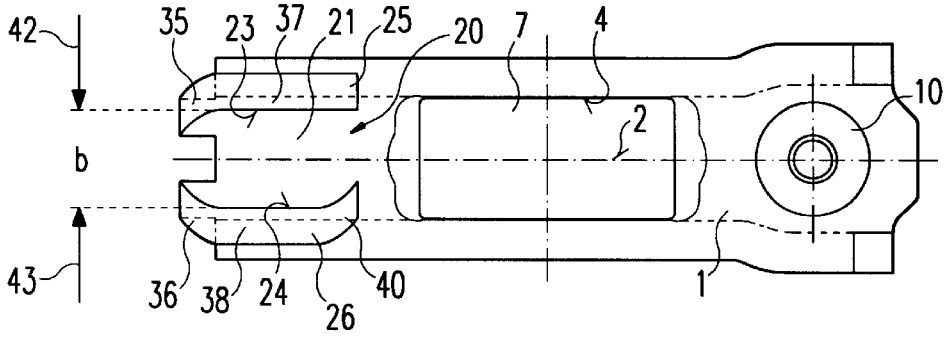

The present invention pertains to a valve actuating lever for transmitting movement of a cam arranged on a camshaft to a gas changing valve of an internal combustion engine.

The task of the invention and its solution will be described in the following using the example of a drag lever. It is to be pointed out that this description is not to be understood as a restriction of the present invention in any way, in fact it is quite possible to realize the present invention with differently configured valve actuating levers as, for example, with rocker arms or with non-roller-actuated valve actuating levers.

A drag lever of this type is known from DE 195 43 657 A1.

Known valve actuating levers have a U-shaped base body having a socket-like recess disposed at one end thereof for supporting the lever in mounted state by means of a supporting element on the cylinder head. A valve contact area is provided at the other end for actuating the gas shuttle valve of the internal combustion engine depending upon the position of the cam on the camshaft.

The cam contacts said valve actuating lever in a cam contact area, whereby with a drag lever, a roller rotatably mounted by means of roller elements is arranged in said cam contact area.

Although this known valve actuating lever fulfills its function to a very satisfactory degree, there is nevertheless still a need to further increase its technical functionality by reducing the weight and thus decreasing the moment of inertia of the lever about its axis of rotation without diminishing stability. In addition, there is a desire to further lower manufacturing costs.

It is therefore the task of the present invention to provide a valve actuating lever and especially a drag lever as well as a method for its manufacture, in which the lever's moment of inertia about the axis of rotation is decreased. A further aspect of this task is to design the inventive valve actuating lever in such a manner that stability is increased relative the state of the art and allows manufacturing at reasonable costs.

This task is solved in accordance with the present invention.

The valve actuating lever in accordance with the present invention has an oblong base body of essentially non-cutting structure, preferably having a U-shaped profile. Said base body is arranged in a longitudinal symmetry plane extending essentially symmetrically longitudinal therefrom. Tabs are arranged at both sides of said longitudinal symmetry plane in the valve contact area, each tab respectively having a lateral surface facing said longitudinal symmetry plane. The tabs are formed onto an end edge of said base body and bent over into the valve contact area.

At least one of said tabs has a connecting portion extending out from said longitudinal symmetry plane in which the clearance spacing between said lateral surfaces increases as well as at least one parallel portion in which said lateral surfaces run essentially parallel to said longitudinal symmetry plane.

The two tabs are arranged spaced at a clearance at the end edge of the base body, said clearance being smaller than the clearance of the lateral surfaces in the parallel portion, whereby said clearance is respectively defined perpendicular to said longitudinal symmetry plane.

The inventive design has numerous substantial advantages.

The clearance spacing of the tabs at the end edge of the elongated base body is a design dimension which defines the width of the elongated base body in the valve contact area. As this spacing is decreased, the width of the elongated base body is simultaneously decreased at least in the valve contact area and thus also its weight. Since the valve contact area is radially distanced from the axis of rotation of the valve actuating lever, a fundamental decrease of the moment of inertia about the axis of rotation of the lever results. This results in a reduction of the force required for actuating the lever at the same number of revolutions and increases the upper allowable rotational limit for the valve operating mechanism with respect to the actuating force.

Since it is possible, with otherwise the same dimensions, to reduce the width of the lever, the lever's bent length is thus also reduced transverse to its longitudinal direction, which allows for an increasing of its stability.

Furthermore, reducing the lever width decreases the material expenditure, which in turn lowers manufacturing costs. In contrast to other manufacturing procedures, the non-cut structure, in which also the tabs are manufactured by a simple stamping and bending process, has in itself considerable cost advantages.

The reduction in lever width has the further advantage that the valve operating mechanism as a whole can be fabricated narrower. Since, due to demands of space economics and weight optimization, engine designers are compelled to develop engines having an overall shortest structural length as possible, the width reduction is of particular significance when, but not only expressly limited thereto, three or more valves per cylinder are to be employed due to performance, consumption and exhaust value mandates.

In a first preferred embodiment, the tabs are formed on the base body before the bending process in such a manner that they extend parallel to the longitudinal symmetry plane, meaning they extend linearly. Bending then transpires in such a manner that one or both tabs are bent away from the longitudinal symmetry plane to form the connecting portion. At the end of said connecting portion, the tabs are then bent in such a manner that the inner lateral surface of said tabs facing the symmetry plane run parallel thereto.

According to structural requirements, a further narrowed portion can be adjoined to these parallel sections in which one or both tabs are again facing the longitudinal symmetry plane.

In a second preferred embodiment of the present invention, the tabs are stamped such that the connecting portion and the parallel portion are already provided in the undeformed tabs. The tabs then only have to be bent 180° and already have the desired contour in the valve contact area in their unbent state without the realization of any further bending process.

The first and second embodiment may also be combined with one another. In this case, the tabs are brought into their initial form by means of a stamping process, then are subsequently bent 180° and then brought into their final form by an additional bending toward or away from the longitudinal symmetry plane.

It is furthermore possible to treat the tabs differently so that, for example, only one tab is subjected to a bending of about 180°, while the other tab undergoes both this bending as well as also a further bending in particular toward or away from said longitudinal symmetry plane. Here the initial form of the tabs can be identical; e.g. the form of an elongated rectangular block having longitudinal edges running parallel to the longitudinal symmetry plane or which differ from one another.

Figure 2:
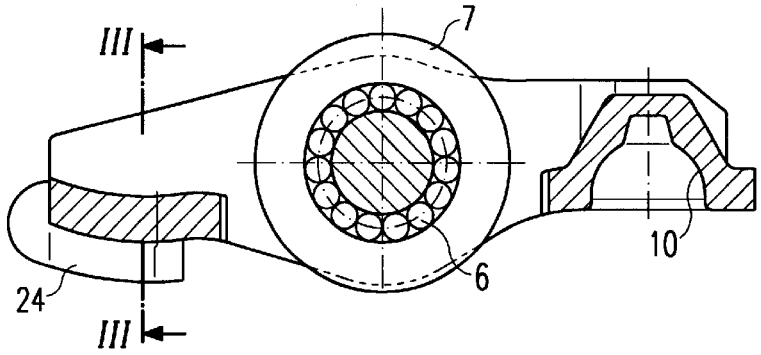
Figure 2A:
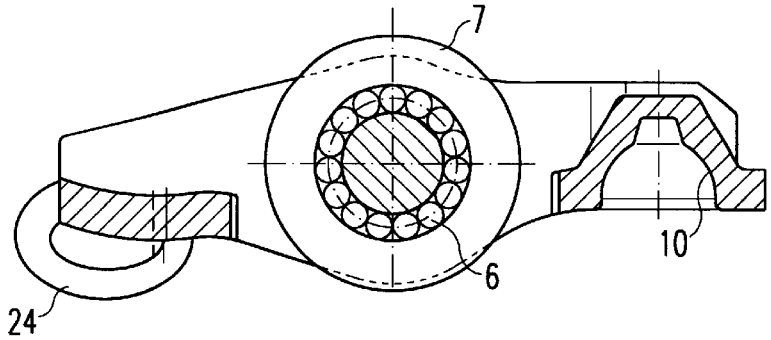
Figure 3:
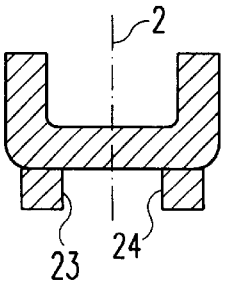
Figure 4:
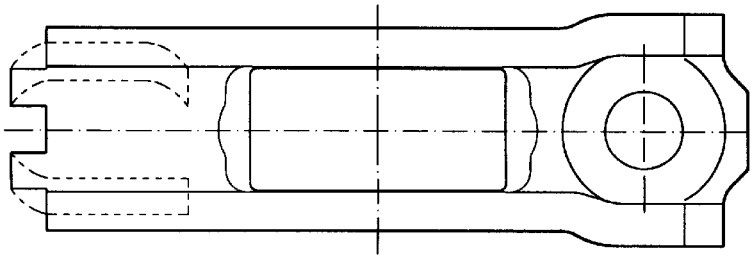
Figure 5:
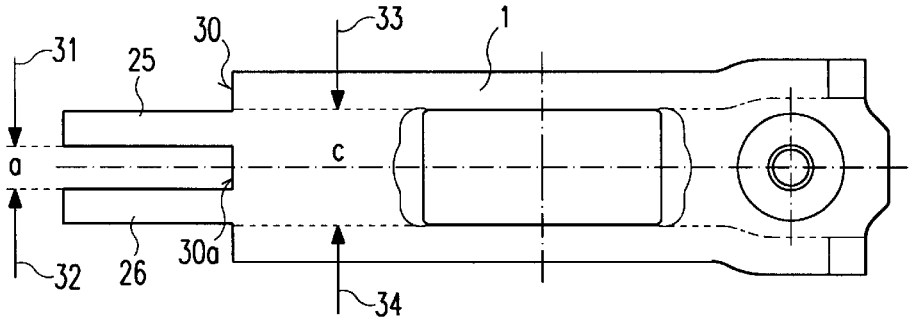
Figure 6:
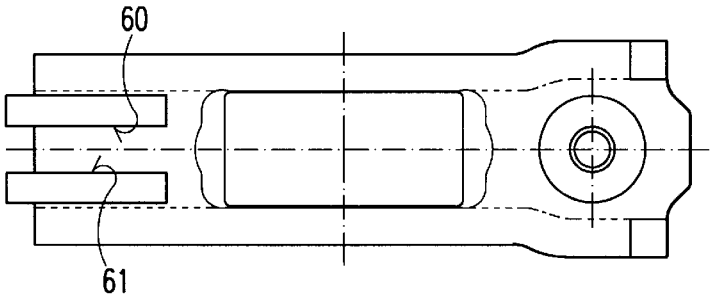
Figure 7:
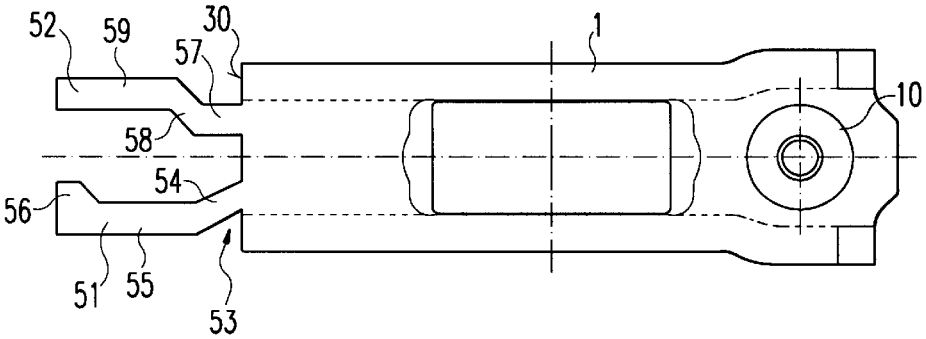
Figure 8:
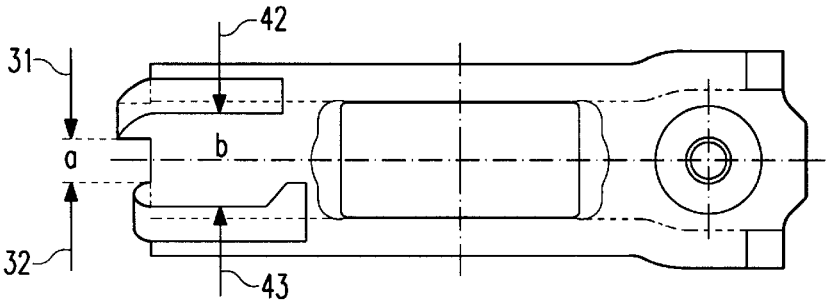

Further advantages, characteristics and possible applications of the present invention will now be described in the following with respect to the embodiments and in reference to the drawings, which show:

FIG. 1 an underside view of a first embodiment of the present invention, which is configured as a drag lever;

FIG. 2 a longitudinal section of the embodiment according to FIG. 1;

FIG. 2*a* a longitudinal section the same as FIG. 2, except with regard to the tab;

FIG. 3 a section through the representation according to FIG. 2 as seen along the lines III—III;

FIG. 4 a plan view of the embodiment according to FIG. 1;

FIG. 5 a view of the drag lever of the embodiment according to FIG. 1 during manufacture, as seen from its underside;

FIG. 6 a representation corresponding to FIG. 5 at a further stage of manufacture;

FIG. 7 a second embodiment of the inventive drag lever at a preceding stage of manufacture, as seen from its underside;

FIG. 8 the drag lever according to FIG. 7 in a view as seen from its underside.

A first embodiment of the present invention will now be described with reference to FIGS. 1–6.

FIG. 1 shows a first embodiment of the drag lever according to the present invention.

The drag lever comprises a base body, its entirety designated with the reference numeral 1, which extends essentially symmetrical along a longitudinal symmetry plane 2. The term "symmetry plane" is not to be understood here in an absolutely strictest geometrical sense, but rather simply means that the fundamental areas of the valve actuating lever are configured symmetrically to said symmetry plane. Symmetry plane 2 extends perpendicular to the drawn plane in the representation according to FIG. 1 and forms the section plane in the representation according to FIG. 2.

The elongated base body is, as can be seen from the representation according to FIG. 3, configured essentially in a U-shape and has a notch 4 extending symmetrically to symmetry plane 2, in which a roller 7 is arranged, mounted via roller elements 6. When mounted, roller 7 contacts the cams of a camshaft.

A recess 10 is disposed in the right part of the representation according to FIG. 1 for receiving a (not shown) supporting element. When mounted, said element is then supported within the (not shown) cylinder head. The configuration of said recess 10 is known in the state of the art, thus not necessitating any further clarification here.

A valve contact area 20 is provided on the left side of the base body in the representation according to FIG. 1. Said valve contact area has a surface 21, which is of slightly convex configuration in the shown embodiment, but which however may also be of a different curvature or of flat configuration.

The valve contact area is restricted by two lateral surfaces 23, 24 facing said longitudinal symmetry plane 2, which are a part of tabs 25, 26.

Tabs 25, 26 are formed on an end edge 30 of said elongated base body 1, whereby end edge 30 is arranged essentially perpendicular to symmetry plane 2. The clearance distancing of tabs 25 and 26 at said end edge of the base body corresponds to length a in FIG. 5 between the arrows 31 and 32 or, to put it another way, tabs 25 and 26 are disposed at the end edge 30 of a trestle 30*a* which has the width c (see FIG. 5) between arrows 33 and 34.

In the embodiment according to FIG. 1, both tabs 25, 26 have a connecting portion 35, 36, in which the tabs extend away from symmetry plane 2. In parallel portion 37, 38 adjoining said connecting portion 35, 36, both tabs extend parallel to symmetry plane 2. A narrowed portion 40 adjoins tab 26, in which the tab again extends to symmetry plane 2.

The term "connecting portion" is consequently defined as that point where the angular alignment of the tabs, respectively the lateral surfaces, change with respect to the longitudinal symmetry plane.

At parallel portion 37, 38, the clearance distancing of the two tabs corresponds to clearance b, as represented between the arrows 42, 43. Said clearance b is larger than clearance a. The difference between the two clearance distances corresponds essentially to the base body's width economizing relative the state of the art as initially discussed above.

In the depicted embodiments, and as depicted particularly well in the representation according to FIG. 2, both tabs 25, 26 lie flush up against the curved surface of the valve contact area 20, meaning abutting without a gap therebetween.

Deviating from this, the tabs may also be configured differently in this embodiment, and also in the following embodiment, such that a gap is provided between the tabs and the surface of the valve contact area, whereby the tabs are then formed such that their end sections abut the valve contact area. As shown in FIG. 2*a*, the tabs are bent in such a manner that they have a clearance from said surface (21) in a partial section and only abut up against said surface (21) at their end sections. In order to fix the end section with respect to the valve contact area, for example in the representation according to FIG. 1 where said end section comprises the narrowed portion 40 on tab 26, in the first alternative, meaning with the flush abutting tabs, as well as also in the second alternative, meaning where the tabs have a partial spacing from said valve contact area, an additional end connection may be fabricated, preferably as a welded joint.

A method for manufacturing this embodiment of the present invention will now be described with respect to FIGS. 5 and 6.

The drag lever depicted in the embodiment is stamped as a whole from a metal sheet and then preferably cold deformed in order to attain the final configuration as shown in FIGS. 1–4. Tabs 25 and 26 are formed in the stamping as essentially linearly extending elongations of base body 1 and then subsequently, as shown in FIG. 6, reshaped downwardly (seen in the drawing's representation), whereby the clearance distancing of the tabs then corresponds to clearance a. The tabs are then subsequently bent away from symmetry plane 2 in order to form connecting portions 35, 36. Said bending process is implemented such that the tabs are first bent outwardly in a first bent angle so as to form a first part of contact area 35, 36 extending outwardly from symmetry plane 2 and then subsequently bent back in such a manner toward symmetry plane 2 that the remaining part of the tabs run parallel to said symmetry plane 2. Both ends of the tabs, or only one as indicated by reference numeral 40 in FIG. 1, is then further formed to have another inwardly bent angle toward symmetry plane 2.

As the representation according to FIGS. 1–6 shows, this configuration makes it possible to realize the valve actuating lever with a narrower width. This allows considerable material savings, whereby the moment of inertia about the axis of rotation is reduced and, with otherwise the same dimensions, stability is increased.

A further embodiment of the present invention will now be described with respect to FIGS. 7 and 8.

In this present embodiment, the final product as basically represented in FIG. 8, namely the drag lever, essentially corresponds to the representation according to FIG. 1. The corresponding reference numerals are thus also utilized here.

A difference arises however in the formation of tabs 51 and 52.

As is shown in the representation according to FIG. 7, the tabs here are actually formed directly during a stamping process so that the desired connecting portion is already rendered during the stamping process and not, as in the embodiment according to FIGS. 1–6, upon bending.

Tab 51 is formed on end edge 30 of base body 1 which extends essentially perpendicular to symmetry plane 2. Tab 51 has a first section in which the tab, also in undeformed state, forms a pointed angle (identified with reference numeral 53) to said end edge 30, whereby a connecting portion 54 pointing away from said longitudinal symmetry plane 2 is formed. A parallel portion 55 follows said connecting portion 54, said parallel portion configured parallel to the longitudinal symmetry plane, as then does a section 56 in which the lateral surface is aligned at a pointed angle to the longitudinal symmetry plane.

A parallel portion 57 is first disposed at tab 52 which extends parallel to longitudinal symmetry plane 2, at which connecting portion 58 then adjoins, at which the tab extends outwardly away from longitudinal symmetry plane 2. Another parallel portion 59 then adjoins, which extends parallel to longitudinal symmetry plane 2 and forms lateral surface 60.

The method for manufacturing the present valve actuating lever is similar to that as described in the previous embodiment. Here as well, the tabs are bent approximately 180°, which results in a drag lever configuration corresponding to FIG. 8. The curvature aligned toward or away from the longitudinal symmetry plane however is omitted here. The stamping tool as a whole is of somewhat more complex configuration as in the embodiment according to FIGS. 1–6, yet offers the otherwise contrasting advantage of facilitating the bending process.

What is claimed is:

1. Valve actuating lever for transmitting movement of a cam arranged on a camshaft to a gas exchange valve of an internal combustion engine comprising:

an essentially non-cut formed oblong base body (1) arranged in a longitudinal symmetry plane (2) extending essentially symmetrically longitudinal therefrom, a valve contact area (20) arranged at a first end of said base body, two tabs (25, 26; 51, 52) arranged at both sides of said longitudinal symmetry plane in said valve contact area, each respectively having a lateral surface (23, 24; 60, 61) aligned facing said longitudinal symmetry plane, whereby said tabs are formed onto said base body and are bent over toward said valve contact area, characterized in that said tabs are arranged spaced at a clearance (a) at an end edge (30) of said base body, said clearance (a) being less than a clearance (b) of said lateral surfaces in said valve contact area, whereby said clearances are respectively measured perpendicular to said longitudinal symmetry plane, and at least one of said tabs has at least one connecting portion (35, 36; 54, 58) extending from said longitudinal symmetry plane in which the clearance between said lateral surfaces enlarges as well as at least one parallel portion (37, 38; 55, 59) in which said lateral surfaces extend essentially parallel to said longitudinal symmetry plane.

2. Valve actuating lever according to claim 1, characterized in that said connecting portion (35, 36) is created through means of plastic deformation.

3. Valve actuating lever according to claim 2, characterized in that said connecting portion (54, 58) is created through means of a delimination process.

4. Valve actuating lever according to claim 1, characterized in that at least one of said tabs comprises a narrowed portion (40) adjoining said parallel portion in which said tab is formed toward said longitudinal symmetry plane (2).

5. Valve actuating lever according to at claim 1, characterized in that said base body is configured of essentially U-shape in a section plane which lies perpendicular to said longitudinal symmetry plane.

6. Valve actuating lever according to claim 1, characterized in that said tabs are of rectangular configuration in cross-section.

7. Valve actuating lever according to claim 1, characterized in that said surface (21) formed by said valve contact area (20) extends in curved configuration and that said tabs are bent in such a manner so as to abut up against same to follow said curvature.

8. Valve actuating lever according to claim 1, characterized in that said surface (21) formed by said valve contact area (20) extends in curved configuration and that said tabs are bent in such a manner that they have a clearance from said surface in a partial section and only abut up against said surface at their end sections.

9. Valve actuating lever according to claim 7, characterized in that said curvature is at least partially a convex curvature.

10. Valve actuating lever according to claim 1, characterized in that said valve lever is configured as a drag lever.

11. Valve actuating lever according to claim 10, characterized in that said valve actuating lever is configured as a roller drag lever.

12. Valve actuating lever according to claim 11, characterized in that said roller drag lever comprises a roller (7) rotatably mounted via roller elements (6).

13. Valve actuating lever according to claim 1, characterized in that said base body (1) is of U-shaped form in cross-section and that said tabs are formed on one end edge (30) of said base body.

14. Method for manufacturing a valve actuating lever in accordance with claim 1 having the following procedural steps:

stamping out the oblong base body (1) configured essentially symmetrical to the longitudinal symmetry plane (2) extending longitudinally therefrom having two tabs (25, 26) arranged at both sides of said longitudinal symmetry plane on an end edge, each respectively having a lateral surface aligned facing said longitudinal symmetry plane, whereby said tabs are formed on said base body and extend parallel to said longitudinal symmetry plane, bending of said tabs at an angle of approximately 180°, bending of at least one of said tabs to form a connecting portion (35, 36) extending from said longitudinal symmetry plane in which the clearance between said lateral surfaces enlarges, as well as at least one parallel portion in which said lateral surfaces extend essentially parallel to said longitudinal symmetry plane.

15. Method for manufacturing a valve actuating lever in accordance with claim 3 having the following procedural steps:

stamping out the oblong base body (1) configured essentially symmetrical to the longitudinal symmetry plane (2) extending longitudinally therefrom having two tabs (51, 52) arranged at both sides of said longitudinal symmetry plane, each respectively having a lateral surface aligned facing said longitudinal symmetry plane, whereby said tabs are formed on said base body and whereby at least one of said tabs comprises at least one connecting portion extending from said longitudinal symmetry plane in which the clearance between said lateral surfaces enlarges as well as at least one parallel portion in which said lateral surfaces extend essentially parallel to said longitudinal symmetry plane, bending of said tabs at an angle of approximately 180°.

16. Valve actuating lever according to claim 6, wherein said tabs are of square configuration in cross-section.

17. Valve actuating lever according to claim 13, wherein said tabs are formed on a trestle (30*a*) of said U-shaped base body (1) of narrower width (c).

* * * * *